US011821682B2

(12) United States Patent
Beck et al.

(10) Patent No.: US 11,821,682 B2
(45) **Date of Patent: *Nov. 21, 2023**

(54) NATURAL GAS PROCESSING USING SUPERCRITICAL FLUID POWER CYCLES

(71) Applicant: Southwest Research Institute, San Antonio, TX (US)

(72) Inventors: Griffin C. Beck, San Antonio, TX (US); David L. Ransom, San Antonio, TX (US); Kevin M. Hoopes, San Antonio, TX (US)

(73) Assignee: SOUTHWEST RESEARCH INSTITUTE, San Antonio, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/586,081

(22) Filed: Jan. 27, 2022

(65) Prior Publication Data

US 2022/0146192 A1 May 12, 2022

Related U.S. Application Data

(62) Division of application No. 16/146,506, filed on Sep. 28, 2018, now Pat. No. 11,268,754.

(51) Int. Cl.

| | |
|---|---|
| ***F25J 1/02*** | (2006.01) |
| ***F25J 1/00*** | (2006.01) |
| ***E21B 43/34*** | (2006.01) |
| ***F01K 11/00*** | (2006.01) |
| ***F01K 9/00*** | (2006.01) |

(Continued)

(52) U.S. Cl.

CPC ..... *F25J 1/0095* (2013.01); *E21B 43/34* (2013.01); *F01K 9/003* (2013.01); *F01K 11/00* (2013.01); *F01K 19/00* (2013.01); *F01K 27/02* (2013.01); *F25J 1/0022* (2013.01); *F25J 1/0055* (2013.01); *F25J 2210/60* (2013.01);

(Continued)

(58) Field of Classification Search

CPC ..... F25J 1/0022; F25J 1/0052; F25J 1/0095; F25J 1/0037; F25J 2210/60; F25J 2260/60; F25J 2260/80; F01K 27/02

See application file for complete search history.

(56) References Cited

U.S. PATENT DOCUMENTS

| | | | |
|---|---|---|---|
| 2003/0089125 | A1 | 5/2003 | Fredheim et al. |
| 2004/0055329 | A1 | 3/2004 | Mathias et al. |

(Continued)

FOREIGN PATENT DOCUMENTS

| | | |
|---|---|---|
| CN | 104266454 | 1/2015 |

*Primary Examiner* — Brian M King

(74) *Attorney, Agent, or Firm* — Grossman, Tucker, Perreault & Pfleger, PLLC

(57) ABSTRACT

The systems and methods described herein integrate a supercritical fluid power generation system with a LNG production/NGL separation system. A heat exchanger thermally couples the supercritical fluid power generation system with the LNG production/NGL separation system. A relatively cool heat transfer medium, such as carbon dioxide, passes through the heat exchanger and cools a first portion of extracted natural gas. The relatively warm heat transfer medium returns to the supercritical fluid power generation system where a compressor and a thermal input device, such as a combustor, are used to increase the pressure and temperature of the heat transfer medium above its critical point to provide a supercritical heat transfer medium. A second portion of the extracted natural gas may be used as fuel for the thermal input device.

11 Claims, 6 Drawing Sheets

(51) Int. Cl.
*F01K 27/02* (2006.01)
*F01K 19/00* (2006.01)

(52) U.S. Cl.
CPC ..... *F25J 2260/60* (2013.01); *F25J 2260/80* (2013.01); *F25J 2270/18* (2013.01); *F25J 2290/60* (2013.01)

(56) References Cited

U.S. PATENT DOCUMENTS

| | | | |
|---|---|---|---|
| 2007/0107464 | A1 | 5/2007 | Ransbarger |
| 2009/0301131 | A1 | 12/2009 | Bakker et al. |
| 2011/0131992 | A1 | 6/2011 | Greeff |
| 2015/0192037 | A1 | 7/2015 | Sharp et al. |
| 2019/0101328 | A1 | 4/2019 | Pierre, Jr. |

NATURAL GAS PROCESSING USING SUPERCRITICAL FLUID POWER CYCLES

CROSS REFERENCE TO RELATED APPLICATIONS

This application is a divisional application of U.S. application Ser. No. 16/146,506, Sep. 28, 2018, now pending. The entire disclosure of which is incorporated herein by reference.

TECHNICAL FIELD

The present disclosure relates to natural gas processing.

BACKGROUND

Stranded natural gas is found in locations remote from end users of the gas. Where stranded natural gas cannot be coupled to market via pipeline, maritime transport may be needed to transport gas. Since large scale transport of gaseous natural gas is uneconomical, natural gas may be liquefied to produce liquefied natural gas (LNG) for transport. The process for the liquefaction of natural gas is essentially the same as that used in modern domestic refrigerators, but on a substantially increased scale. A refrigerant gas is compressed, cooled, condensed, and let down in pressure through a valve that reduces its temperature via the Joule-Thomson effect. The refrigerant gas is then used to cool the extracted natural gas. The temperature of the extracted natural gas is reduced to −161° C., the temperature at which methane, the main constituent of the extracted natural gas, liquefies. At this temperature, other hydrocarbon compounds (e.g., ethane, propane, butane) present in the extracted natural gas will also liquefy. Constituents of the extracted natural gas ($C_2$, $C_3$, and $C_4$ hydrocarbons), either individually or as a mixture, may be used as the refrigerant gas in the LNG liquefaction process. Extracted natural gas pretreatment and refrigerant gas component recovery are normally included in the LNG liquefaction facility. Liquefied petroleum gas (LPG—mainly $C_3$ and $C_4$ hydrocarbons) and condensate may be recovered as byproducts.

Supercritical carbon dioxide is an emerging technology for improved power cycle efficiency in the United States and around the world. The physical properties of carbon dioxide (critical temperature of 548° Rankine (° R) and critical pressure of 1071 psia) and the dynamics of the energy generation cycle result in a combination of high operating temperatures and high operating pressures in the thermal input equipment (e.g., combustors) used to heat the supercritical carbon dioxide. The combination of operating temperatures (e.g., temperatures in excess of 1,000° F.) and high operating pressures (e.g., in excess of 3,000 psia) requires the use of exotic and/or high cost materials of construction capable of withstanding such conditions.

Supercritical carbon dioxide power cycles are currently being developed and demonstrated for next generation utility scale nuclear and fossil fuel power generation, modular nuclear power generation, solar-thermal power generation, shipboard propulsion, geothermal power generation, and waste heat recovery applications. Cycle and component development is often driven by interest in compact, high efficiency, cycles that use minimal or, ideally, no makeup water and which are compatible with dry cooling to replace traditional steam Rankine cycles and combined cycles for utility-scale power generation and organic Rankine cycles for waste heat recovery. Closed Brayton cycles achieve high efficiencies by leveraging recuperation in the closed Brayton cycle to minimize thermal losses and through reduced compression work by leveraging the unique characteristics of supercritical carbon dioxide. Such characteristics include high fluid density, low viscosity, and high heat capacity at pressures greater than the critical pressure of carbon dioxide and temperatures greater than the critical temperature of carbon dioxide.

BRIEF DESCRIPTION OF THE DRAWINGS

Features and advantages of various embodiments of the claimed subject matter will become apparent as the following Detailed Description proceeds, and upon reference to the Drawings, wherein like numerals designate like parts, and in which:

Figure 1:
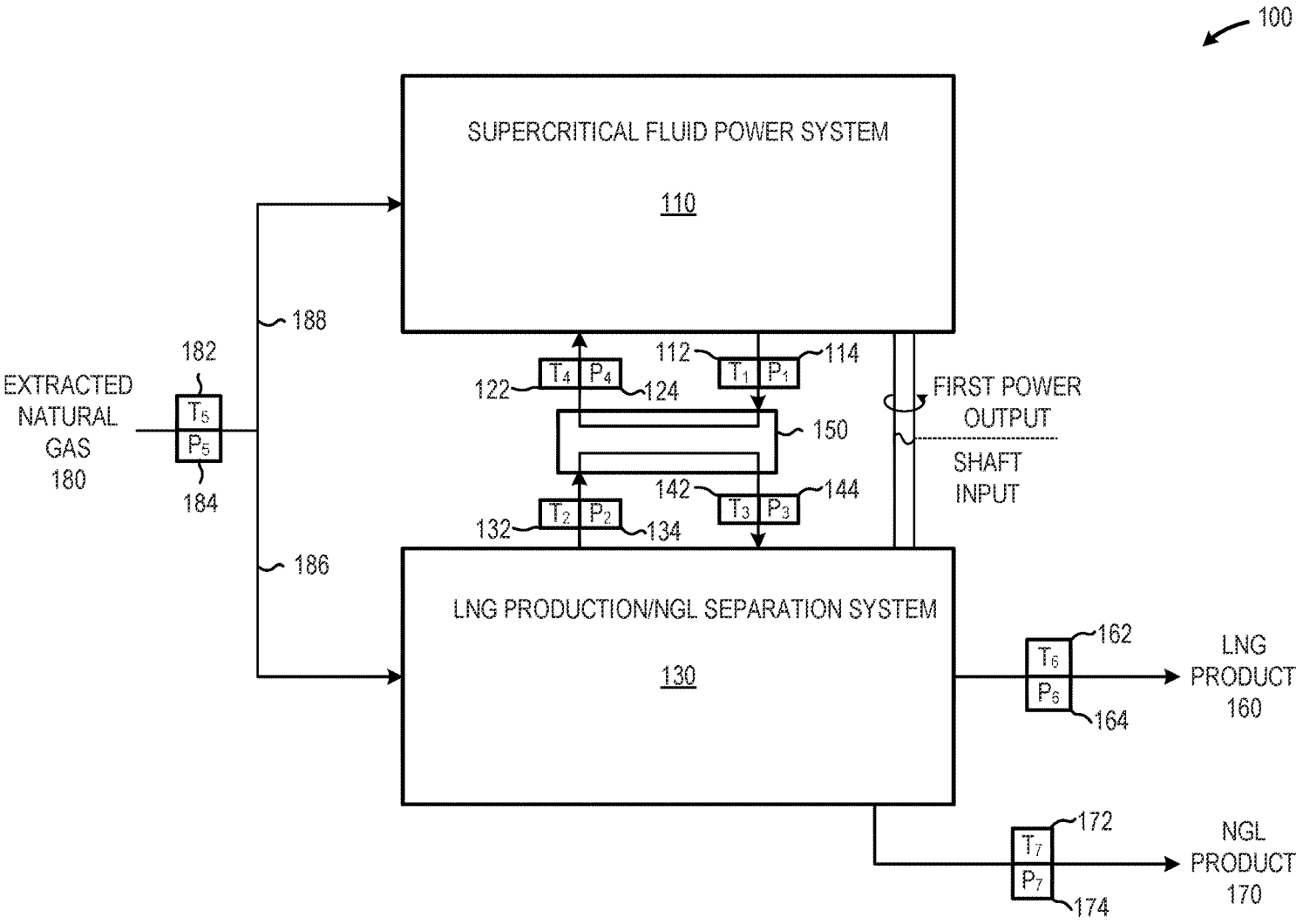
FIG. 1 is a block diagram of an illustrative integrated system that includes a supercritical fluid power system and a LNG production/NGL separation system thermally coupled via one or more heat exchangers in which a thermal transfer medium from the supercritical fluid power system at a first temperature ($T_1$) and a first pressure ($P_1$) is used as a refrigerant to cool extracted natural gas from the LNG production/NGL separation system from a second temperature ($T_2$) and a second pressure ($P_2$) to a third temperature ($T_3$) and a third pressure ($P_3$), in accordance with at least one embodiment described herein.

Although the following Detailed Description will proceed with reference being made to illustrative embodiments, many alternatives, modifications and variations thereof will be apparent to those skilled in the art.

DETAILED DESCRIPTION

The systems and methods disclosed herein provide for systems and methods that integrate a power cycle using a supercritical thermal transfer medium (e.g., supercritical carbon dioxide) with a liquefied natural gas ("LNG") production/natural gas liquids ("NGL") separation system. The systems and methods described herein beneficially and advantageously employ the supercritical thermal transfer medium used in the power cycle as a refrigerant to cool "new," or extracted natural gas. The use of the supercritical thermal transfer medium as a refrigerant beneficially and advantageously minimizes, or even eliminates the need for an intermediate thermal transfer medium, such as water or glycol solutions, to thermally couple the supercritical fluid power generation system and the LNG production/NGL separation system. Consequently, the systems and methods described herein may be used in remote and/or arid locations where availability of such coolants is limited or non-existent. The close integration of the supercritical fluid power cycle with the LNG production/NGL separation process beneficially eliminates the need for an isolation and/or cooling loop between the supercritical fluid power generation system and the LNG production/NGL separation system. Additionally, the use of a non-flammable, easily separated coolant, such as supercritical carbon dioxide, beneficially mitigates the risk of fire/explosion as well as reduces the likelihood of contamination of the LNG/NGL products.

The systems and methods described herein include at least one heat exchanger disposed between and thermally coupling the supercritical fluid power generation system and the LNG production/NGL separation system. The at least one heat exchanger may receive a multiphase thermal transfer medium from the supercritical fluid power generation system and a relatively warm natural gas from the LNG production/NGL separation system. Within the at least one heat exchanger the natural gas is cooled and/or at least partially condensed by evaporating at least a portion of the multiphase thermal transfer fluid. The evaporated thermal transfer fluid returns from the heat exchanger to the supercritical fluid power system where the temperature and pressure of the thermal transfer fluid are increased to provide a supercritical thermal transfer fluid. The cooled/condensed natural gas returns to the LNG production/NGL separation system where one or more NGL products may be separated from the natural gas and the liquefied natural gas provided to storage and/or transport.

The supercritical fluid power generation system employs a supercritical thermal transfer medium, such as supercritical carbon dioxide ($CO_2$). The thermal transfer medium is heated using a thermal input device, such as a combustor or heater using at least a portion of the extracted natural gas as a fuel source, to produce the supercritical thermal transfer fluid. The supercritical thermal transfer fluid expands through a turbine to produce a power output. The thermal transfer medium exiting the turbine is compressed. A first portion of the compressed thermal transfer medium is provided to the combustor. A second portion of the compressed thermal transfer fluid is expanded, for example through one or more expansion valves, to provide a relatively cool thermal transfer medium used as a refrigerant to cool the extracted natural gas via the at least one heat exchanger. The thermal transfer medium returned from the at least one heat exchanger is recompressed. The supercritical fluid power generation system may include one or more recuperated or non-recuperated, direct- or indirect-fired Brayton cycles. The thermal transfer medium may include $CO_2$ or any other material, substance, or mixture having similar thermodynamic properties, critical pressure, and/or critical temperature.

The LNG production/NGL separation system employs a cryogenic process to cool the extracted natural gas to condense and remove natural gas liquids and to liquefy the natural gas. A compressor increases the pressure of the extracted natural gas. The shaft output of the turbine in the supercritical fluid power generation system provides at least a portion of the power input to the compressor. The compressed natural gas enters the at least one heat exchanger where the extracted natural gas is refrigerated by evaporating at least a portion of the thermal transfer medium. The temperature of the cooled natural gas is further reduced to condense natural gas liquids present in the extracted natural gas. The temperature of the refrigerated natural gas may be further reduced to provide a liquefied natural gas (LNG) product. The LNG production/NGL separation system may cryogenically separate one or more natural gas liquid (NGL) products from the extracted natural gas. Thus, the supercritical fluid power generation system provides both a power output and refrigerant used by the LNG production/NGL separation system.

A natural gas processing system is provided. The natural gas processing system may include a supercritical fluid power generation system to: receive a thermal energy input; and provide a multiphase heat transfer medium at a first temperature and pressure. The natural gas processing system may further include a LNG production/NGL separation system to: receive a first portion of extracted natural gas; and provide the first portion of the extracted natural gas at a second temperature and a second pressure, wherein the second temperature of the first portion of the extracted natural gas is greater than the first temperature of the multiphase heat transfer medium. The natural gas processing system may further include: a heat exchanger fluidly coupled to the supercritical fluid power generation system and to the LNG production/NGL separation system, the heat exchanger to: receive the first portion of the extracted natural gas at the second temperature and the second pressure from the LNG production/NGL separation system; return the first portion of the extracted natural gas at a third temperature and a third pressure to the LNG production/NGL separation system, the third temperature less than the second temperature; receive the multiphase heat transfer medium at the first temperature and the first pressure from the supercritical heat transfer medium power generation system; evaporate at least a portion of the multiphase heat transfer medium to provide a gaseous heat transfer medium at a fourth temperature and a fourth pressure, the fourth temperature at or above the third temperature; and return the gaseous heat transfer medium to supercritical fluid power generation system.

A natural gas processing method is provided. The natural gas processing method may include: generating, by a supercritical fluid power generation system, a multiphase heat transfer medium at a first temperature and a first pressure. The method may further include generating, by a LNG production/NGL separation system, a first portion of extracted natural gas at a second temperature and a second pressure, wherein the second temperature of the first portion of the extracted natural gas is greater than the first temperature of the multiphase fluid. The method may additionally include cooling, via a heat exchanger fluidly coupled to the natural gas liquefaction system and to the supercritical heat transfer fluid power generation system, the first portion of the natural gas from the second temperature and the second pressure to a third temperature and a third pressure to the natural gas liquefaction system, the third temperature less than the second temperature. The method may further include evaporating, via the heat exchanger, at least a portion of the multiphase heat transfer medium at the first temperature and the first pressure to provide a gaseous heat transfer medium at a fourth temperature and a fourth pressure, the fourth temperature at or above the third temperature. The method may additionally include receiving, by the supercritical fluid power generation system, the gaseous heat transfer medium at a fourth temperature and a fourth pressure; and receiving, by the natural gas liquefaction system, the first portion of the extracted natural gas at the third temperature and the third pressure.

Although the following disclosure uses carbon dioxide ($CO_2$) as an illustrative supercritical material for use in power generation cycles, the principles disclosed herein also apply to other substances having a critical temperature and a critical pressure similar to that of $CO_2$ (critical temperature=548° R; critical pressure=1,071 psia). Such substances should be considered as included as part of this disclosure. Non-limiting examples of such materials include: ethane (critical temperature=550° R; critical pressure=708 psia); ethylene (critical temperature=509° R; critical pressure=735 psia); nitrous oxide (critical temperature=557° R; critical pressure=1048 psia); and similar.

FIG. 1 is a block diagram of an illustrative integrated system 100 that includes a supercritical fluid power system 110 and a LNG production/NGL separation system 130 that are thermally coupled via one or more heat exchangers 150 in which a thermal transfer medium from the supercritical fluid power system 110 at a first temperature ($T_1$) 112 and a first pressure ($P_1$) 114 is used to cool extracted natural gas from the LNG production/NGL separation system 150 from a second temperature ($T_2$) 132 and a second pressure ($P_2$) 134 to a third temperature ($T_3$) 142 and a third pressure ($P_3$) 144, in accordance with at least one embodiment described herein. As depicted in FIG. 1, extracted natural gas 180 at a fifth temperature ($T_5$) 182 and a fifth pressure ($P_5$) 184 is apportioned into a first portion 186 introduced to the LNG production/NGL separation system 130 and a second portion 188 introduced to the supercritical fluid power system 110. In embodiments, the LNG production/NGL separation system 130 separates the first portion of extracted natural gas 186 into liquefied natural gas 160 at a sixth temperature ($T_6$) 162 and a sixth pressure ($P_6$) 164. In embodiments, the LNG production/NGL separation system 130 may separate one or more $C_2$ or heavier hydrocarbons from the first portion of the extracted natural gas 186 as natural gas liquids 170 at a seventh temperature 172 and a seventh pressure 174.

The supercritical fluid power generation system 110 may include any number and/or combination of currently available and/or future developed systems, components, subsystems, and/or devices capable of providing the thermal transfer medium at the first temperature 112 and the first pressure 114 to the heat exchanger 150 and receiving the thermal transfer medium at the fourth temperature 122 and the fourth pressure 124 from the heat exchanger 150. The heat transfer medium may be supplied to the heat exchanger 150 as a supercritical fluid, liquid, gas, or a multiphase mixture of liquid and gas at the first temperature 112 and the first pressure 114. The heat transfer medium may return to the supercritical fluid power generation system 110 as a supercritical fluid, liquid, gas, or a multiphase mixture of liquid and gas at the fourth temperature 122 and the fourth pressure 124.

The supercritical fluid power generation system 110 may include a closed (i.e., an indirect-fired) supercritical fluid power generation system or an open (i.e., a direct-fired) supercritical fluid power generation system. Generally, the supercritical fluid power generation system 110 increases the temperature and pressure of the thermal transfer medium above the critical temperature and critical pressure of the medium to cause the thermal transfer medium to transition to a supercritical state. The supercritical fluid is expanded to create a first power output and recompressed and heated to renew the cycle. The thermal input to the supercritical fluid power generation system 110 may be provided using any active (combustion, nuclear fission, etc.) or passive (solar collection/concentration, industrial/commercial waste heat recovery, etc.) source of thermal energy. As depicted in FIG. 1, in embodiments, a second portion 188 of the extracted natural gas 180 may be used as a fuel source to heat the thermal transfer fluid within the supercritical fluid power generation system 110. In embodiments, all or a portion of the first power output produced by the supercritical fluid power generation system 110 may be used to compress the expanded thermal transfer fluid to a pressure greater than the critical pressure of the thermal transfer fluid. In embodiments, all or a portion of the first power output produced by the supercritical fluid power generation system 110 may provide a power input used to compress the natural gas within the LNG production/NGL separation system 130. In embodiments, all or a portion of the first power output produced by the supercritical fluid power generation system 110 may be used to generate electrical power.

The thermal transfer medium may include one or more materials, compounds, or mixtures. In embodiments, the thermal transfer medium may include carbon dioxide ($CO_2$). In embodiments, the thermal transfer medium may include one or more materials and/or compounds having a critical pressure and/or a critical temperature similar to that of $CO_2$. For clarity and conciseness, the subsequent discussion will use $CO_2$ as an illustrative thermal transfer medium. However, the thermal transfer medium used in the supercritical fluid power generation system 110 is not limited to $CO_2$ and alternative thermal transfer media, such as ethane, ethylene, or nitrous oxide may be similarly employed and should be considered within the scope of this disclosure.

In embodiments, the heat exchanger 150 may receive multiphase $CO_2$ from the supercritical fluid power generation system 110. The heat exchanger 150 receives the multiphase $CO_2$ at the first temperature 112 and the first pressure 114. In embodiments, the multiphase $CO_2$ provided by the supercritical fluid power generation system 110 to the heat exchanger 150 may be at a first temperature 112 of about 420° R to about 550° R. In embodiments, the multiphase $CO_2$ provided by the supercritical fluid power generation system 110 to the heat exchanger 150 may be at a first pressure 114 of about 150 psia to about 2200 psia.

Within the heat exchanger 150, at least a portion of the multiphase liquid evaporates, cooling the natural gas provided to the heat exchanger 150 by the LNG production/NGL separation system 130. In embodiments, the multiphase $CO_2$ provided to the heat exchanger 150 exits as a gaseous $CO_2$ at the fourth temperature 122 and the fourth pressure 124. In embodiments, the gaseous $CO_2$ returned to the supercritical fluid power generation system 110 from the heat exchanger 150 may be at a fourth temperature 122 of about 420° R to about 700° R. In embodiments, the gaseous $CO_2$ returned to the supercritical fluid power generation system 110 from the heat exchanger 150 may be at a fourth pressure 124 of about 150 psia to about 2200 psia.

The heat exchanger 150 receives natural gas at the second temperature 132 and the second pressure 134 and returns refrigerated natural gas to the LNG production/NGL separation system 130 at the third temperature 142 and the third pressure 144. In embodiments, the heat exchanger 150 receives the first portion 186 of the extracted natural gas 180 at a second temperature 132 of about 450° R to about 800° R. In embodiments, the heat exchanger 150 may receive the first portion 186 of the extracted natural gas 180 at a second pressure 142 of about 15 psia to about 1,500 psia. The heat exchanger 150 returns the refrigerated natural gas to the LNG production/NGL separation system 130 at the third temperature 142 and the third pressure 144. In embodiments, the heat exchanger 150 may return the refrigerated natural gas to the LNG production/NGL separation system 130 at a third temperature 142 of about 425° R to about 600° R. In embodiments, the heat exchanger 150 may return the refrigerated natural gas to the LNG production/NGL separation system 130 at a third pressure 144 of about 15 psia to about 1,500 psia.

The heat exchanger 150 may include any number and/or combination of currently available and/or future developed heat exchange devices capable of exchanging thermal energy between the extracted natural gas 180 and the thermal transfer medium from the supercritical fluid power generation system 110. In embodiments, the heat exchanger 150 may remove thermal energy from the extracted natural gas to reduce the temperature of the extracted natural gas. In embodiments, the heat exchanger 150 may vaporize or evaporate at least a portion of the multiphase $CO_2$ provided by the supercritical fluid power generation system 110 using the thermal energy removed from the extracted natural gas. Sizing and selection of the heat exchange surface within the heat exchanger 150 may be based, at least in part, on one or more of: the thermal transfer media flowrate; the extracted natural gas flowrate; the extracted natural gas inlet temperature (i.e., the second temperature 132); the thermal transfer medium inlet temperature (i.e., the first temperature 112); a desired extracted natural gas outlet temperature (i.e., the third temperature 142); and/or a desired thermal transfer medium outlet temperature (i.e., the fourth temperature 122). In embodiments, the heat exchanger 150 may include, but is not limited to: a shell-and-tube heat exchanger; a plate and frame heat exchanger; a microchannel heat exchanger; a spiral wound heat exchanger; or combinations thereof.

The composition of extracted natural gas 180 varies by location and subterranean formation, however the extracted natural gas 180 contains methane ($CH_4$) and may contain lesser quantities of hydrogen, nitrogen, oxygen, and $C_{2+}$ hydrocarbons. In embodiments, the extracted natural gas 180 may be at a fifth temperature 182 and a fifth pressure 184. In embodiments, the extracted natural gas 180 may be at a fifth temperature 182 of about 420° R to about 650° R. In embodiments, the extracted natural gas 180 may be at a pressure of about 100 psia to about 1,000 psia. The extracted natural gas 180 may be apportioned into a first portion 186 and a second portion 188. In embodiments, the first portion 186 of the extracted natural gas 180 may be introduced to the LNG production/NGL separation system 130 to provide a liquefied natural gas product 160 at a sixth temperature 162 and a sixth pressure 164. In embodiments, the second portion 188 of the natural; gas 180 may be introduced to the first portion 186 of the extracted natural gas 180 may be introduced to the LNG production/NGL separation system 130 to provide a natural gas liquid (NGL) product at a seventh temperature 172 and a seventh pressure 174. In embodiments, the second portion 188 of the extracted natural gas 180 may be introduced to the supercritical fluid power generation system 110. The second portion 188 of the extracted natural gas 180 may be used as a fuel source within a combustor or heater used to raise the temperature of the $CO_2$ used as the thermal transfer medium in the supercritical fluid power generation system 110 above the critical temperature of $CO_2$ (i.e., above 548° R).

The LNG production/NGL separation system 130 may include any number and/or combination of devices and/or systems capable of receiving the extracted natural gas 180 and providing the extracted natural gas as a liquefied natural gas 160. In embodiments, the LNG production/NGL separation system 130 may separate and liquefy $C_2$ and higher hydrocarbons to provide the natural gas liquids 170. In embodiments, the LNG production/NGL separation system 130 may include one or more cryogenic separation processes. Evaporation of the multiphase thermal transfer fluid in the heat exchanger 150 may provide at least a portion of the cryogenic cooling used by the LNG production/NGL separation system 130 to condense the extracted natural gas 180 and/or separate $C_2$ and higher hydrocarbons from the extracted natural gas 180.

The LNG production/NGL separation system 130 may produce, output, or otherwise discharge a liquefied natural gas 160 product at a sixth temperature ($T_6$) 162 and a sixth pressure ($P_6$) 164. The liquefied natural gas 160 may have a minimum methane concentration of: greater than about 85 mol %; greater than about 90 mol %; greater than about 95 mol %; greater than about 97 mol %; or greater than about 99 mol %. The liquefied natural gas 160 may have a sixth temperature 162 of: less than about 150° R; less than about 200° R; less than about 250° R; less than about 300° R; less than about 350° R; or less than about 400° R. The liquefied natural gas 160 may have a sixth pressure 164 of: less than about 500 psia; less than about 400 psia; less than about 300 psia; less than about 200 psia; less than about 100 psia; less than about 50 psia; or less than about 20 psia.

The LNG production/NGL separation system 130 may produce, output, or otherwise discharge a natural gas liquids (NGL) 170 product at a seventh temperature ($T_7$) 172 and a seventh pressure ($P_7$) 174. The natural gas liquids 170 may include ethane, propane, butane, and $C_5$+ hydrocarbons. The natural gas liquids 170 may be at a seventh temperature 172 of: less than about 250° R; less than about 300° R; less than about 350° R; less than about 400° R; less than about 500° R; or less than about 600° R. The natural gas liquids 170 may be at a seventh pressure 174 of: less than about 500 psia; less than about 400 psia; less than about 300 psia; less than about 200 psia; less than about 100 psia; less than about 50 psia; or less than about 20 psia.

Figure 2:
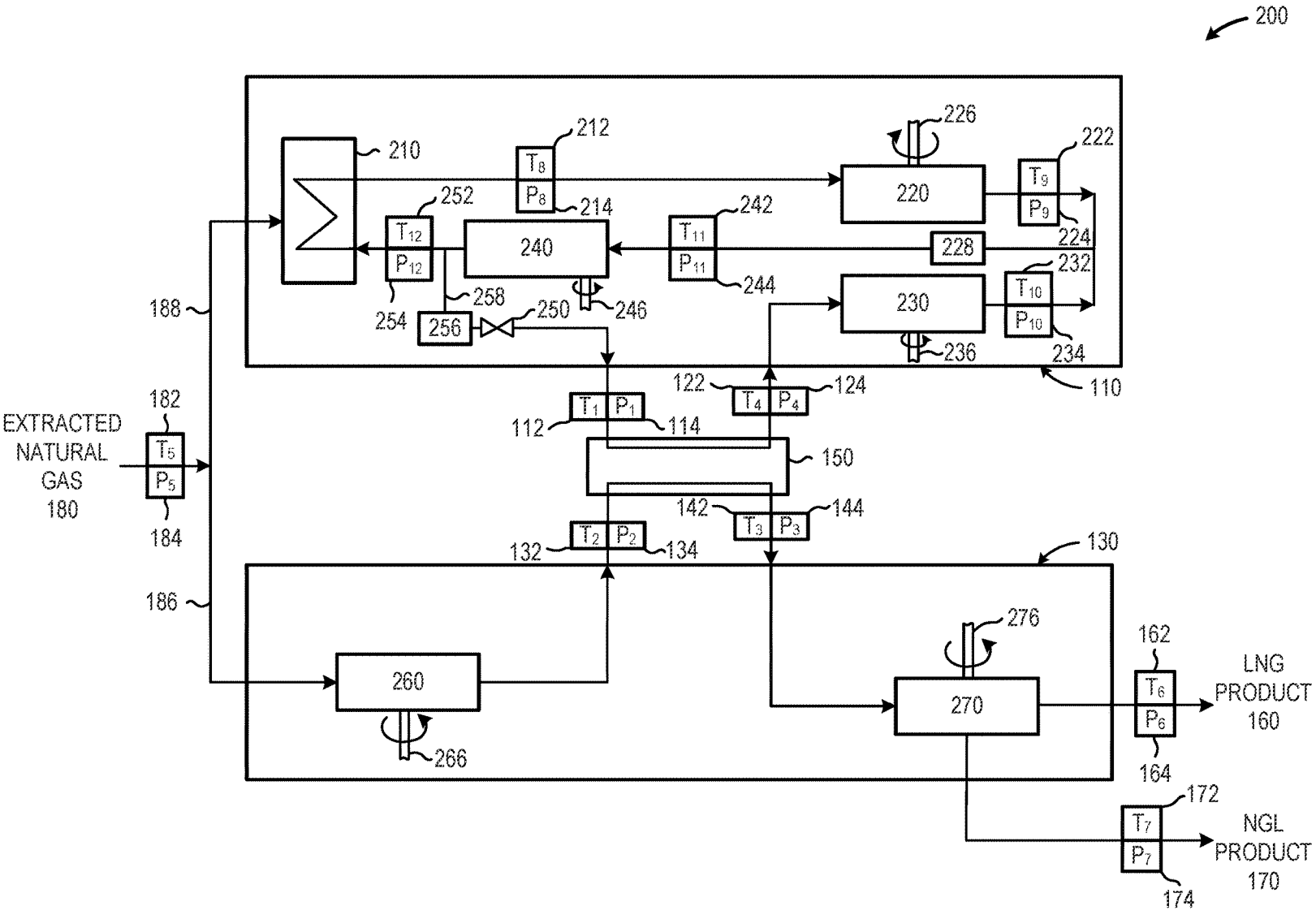
FIG. 2 is a block diagram of an illustrative integrated system that includes a supercritical fluid power system that includes: an indirect-fired combustor, a thermal transfer medium turbine, a first thermal transfer medium compressor, a second thermal transfer medium compressor, and an expansion valve, in accordance with at least one embodiment described herein.

FIG. 2 is a block diagram of an illustrative integrated system 200 that includes a supercritical fluid power system 110 that includes: an indirect-fired combustor 210, a turbine 220, a first compressor 230, a second compressor 240, and an expansion valve 250, in accordance with at least one embodiment described herein. The illustrative integrated system 200 also includes a LNG production/NGL separation system 130 that includes a natural gas compression subsystem 260 and a natural gas liquid subsystem 270. As depicted in FIG. 2, the first portion 186 of the extracted natural gas 180 is directed to the LNG production/NGL separation system 130 and a second portion 188 of the natural gas 180 is used as a fuel in a combustor 210 disposed in the supercritical fluid power generation system 110. The combustor 210 provides supercritical $CO_2$ at an eighth temperature ($T_8$) 212 and an eighth pressure ($P_8$) 214 to a turbine 220. The supercritical $CO_2$ expands through the turbine 220 creating a power output 226. The turbine 220 discharges $CO_2$ at a ninth temperature ($T_9$) 222 and a ninth pressure ($P_9$) 224.

The first compressor 230 receives the gaseous $CO_2$ returning from the heat exchanger 150 at the fourth temperature 122 and the fourth pressure 124. The first compressor 230 increases the temperature and pressure of the gaseous $CO_2$ to provide a gaseous $CO_2$ at a tenth temperature ($T_{10}$) 232 and a tenth pressure ($P_{10}$) 234. In embodiments, all or a portion of the gaseous $CO_2$ at a ninth temperature 222 and a ninth pressure 224 provided by the turbine 220 and all or a portion of the gaseous $CO_2$ at a tenth temperature 232 and a tenth pressure 234 provided by the first compressor 230 may be combined to provide a gaseous $CO_2$ at an eleventh temperature ($T_{11}$) 242 and an eleventh pressure ($P_{11}$) 244. The second compressor 240 receives the gaseous $CO_2$ at an eleventh temperature 242 and an eleventh pressure 244. The second compressor 240 discharges a liquid $CO_2$ at a twelfth temperature ($T_{12}$) 252 and a twelfth pressure ($P_{12}$) 254. The liquid $CO_2$ discharge from the second compressor 240 is apportioned into a first portion 256 that is returned to the combustor 210 and a second portion 258 that is cooled using cooler 256, such as an air-cooler, prior to introduction to the expansion valve 250. The liquid $CO_2$ at the twelfth temperature 252 and a twelfth pressure 254 exits the expansion valve 250 as a multiphase $CO_2$ at the first temperature 112 and the first pressure 114.

The LNG production/NGL separation system 130 includes a compressor 260 to receive the first portion of the extracted natural gas 186 at the fifth temperature 182 and the fifth pressure 184 and discharge at least a portion of the first portion of the extracted natural gas 186 at the second temperature 132 and the second pressure 134. The LNG production/NGL separation system 130 also includes a refrigeration system 270 to condense and separate at least a portion of the natural gas liquid (NGL) product 170 present in the first portion of the extracted natural gas 186. The refrigeration system 270 may also liquefy at least a portion of the first portion of the extracted natural gas 186 to provide the liquefied natural gas (LNG) product 160.

The combustor 210 may include any number and/or combination of currently available and/or future developed, indirect-fired, thermal input devices capable of combusting the second portion of extracted natural gas 188 to increase the liquefied $CO_2$ received from the second compressor 240 at the twelfth temperature 252 and the twelfth pressure 254 to a temperature in excess of the critical temperature of $CO_2$. The combustor 210 may include one or more heat exchangers or similar devices that provide a heat transfer surface to transfer at least a portion of the thermal energy to the liquid $CO_2$ to provide a supercritical $CO_2$ at the eighth temperature 212 and the eighth pressure 214 to the turbine 220. In embodiments, the combustor 210 may provide supercritical $CO_2$ having an eighth temperature 212 of: about 800° R to about 2,000° R; about 900° R to about 1,800° R; or about 1,000° R to about 1,700° R. In embodiments the combustor 210 may provide supercritical $CO_2$ having an eighth pressure 214 of: about 1,000 psia to about 4,500 psia; about 1,000 psia to about 3,000 psia; or about 1,000 psia to about 2,500 psia.

The turbine 220 receives the supercritical $CO_2$ at the eighth temperature 212 and the eighth pressure 214. The supercritical $CO_2$ expands through the turbine 220 generating a power output 226. The $CO_2$ exits the turbine 220 as gaseous $CO_2$ at the ninth temperature 222 and the ninth pressure 224. In embodiments, the gaseous $CO_2$ exiting the turbine 220 may have a ninth temperature 222 of: about 1,400° R to about 2,100° R; about 1,500° R to about 2,000° R; or about 1,600° R to about 1,800° R. In embodiments, the gaseous $CO_2$ exiting the turbine 220 may be at a ninth pressure 224 of: about 200 psia to about 1,200 psia; about 300 psia to about 1,100 psia; or about 400 psia to about 1,000 psia.

The turbine 220 may include any number and/or combination of currently available or future developed systems and/or devices capable of receiving supercritical $CO_2$ from the combustor 210 at the eighth temperature 212 and the eighth pressure 214, expanding the supercritical $CO_2$ to provide the gaseous $CO_2$ at the ninth temperature 222 and the ninth pressure 224, and producing the first power output 226. The turbine 220 may include a single- or multi-stage turbine and/or turboexpander. In embodiments, the first power output 226 may include a rotating shaft output. In embodiments, the first power output 226 may include a rotating shaft output that may be used to provide all or a portion of a power input to an electrical production device or system, such as an electrical generator.

The first compressor 230 receives the gaseous $CO_2$ exiting the heat exchanger 150 at the fourth temperature 122 and the fourth pressure 124. The first compressor 230 may include any number and/or combination of currently available and/or future developed systems and/or devices capable of increasing the pressure of the gaseous $CO_2$ received from the heat exchanger 150 to provide a compressed gaseous $CO_2$ at a tenth temperature ($T_{10}$) 232 and a tenth pressure ($P_{10}$) 234. In embodiments, the first compressor 230 may include one or more reciprocating compressors, one or more rotary compressors, one or more scroll compressors, or combinations thereof. In embodiments, the first compressor 230 may include one or more single- or multi-stage supersonic compressors that increase the density of the $CO_2$ using a supersonic shockwave. Selection of the first compressor 230 may be based on one or more factors, such as process operating conditions (e.g., the fourth temperature 122 and the fourth pressure 124); desired output conditions (e.g., the tenth temperature 232 and/or the tenth pressure 234); gaseous $CO_2$ flowrate; or any combination thereof. In embodiments, the first compressor 230 receives a power input 236. In embodiments, the power input 236 may be provided, in whole or in part, by the first power output 226 of the turbine 220.

The first compressor 230 receives the warmed gaseous $CO_2$ at the fourth temperature 122 and the fourth pressure 124 and compresses the gaseous $CO_2$ to provide the gaseous $CO_2$ the tenth temperature 232 and the tenth pressure 234. In embodiments, the first compressor 230 discharges the compressed gaseous $CO_2$ at a tenth temperature 232 of: about 400° R to about 1,000° R; about 500° R to about 900° R; or about 550° R to about 800° R. In embodiments, the first compressor 230 discharges the compressed gaseous $CO_2$ at a tenth pressure 234 of: about 200 psia to about 1,200 psia; about 300 psia to about 1,100 psia; or about 400 psia to about 1,000 psia.

As depicted in FIG. 2, in embodiments, all or a portion of the gaseous $CO_2$ discharge from the turbine 220 and all or a portion of the gaseous $CO_2$ discharge from the first compressor 230 may be combined and cooled using one or more cooling systems 228, such as an air cooler, to provide a gaseous $CO_2$ feed at an eleventh temperature ($T_{11}$) 242 and an eleventh pressure ($P_{11}$) 244 to the second compressor 240. In embodiments, the gaseous $CO_2$ feed to the second compressor 240 may have an eleventh temperature 242 of: about 400° R to about 1,000° R; about 500° R to about 900° R; or about 550° R to about 800° R. In embodiments, the gaseous $CO_2$ feed to the second compressor 240 may have an eleventh pressure 244 of: about 200 psia to about 1,200 psia; about 300 psia to about 1,100 psia; or about 400 psia to about 1,000 psia.

The second compressor 240 receives the gaseous $CO_2$ at the eleventh temperature 242 and the eleventh pressure 244. The second compressor 240 may include any number and/or combination of currently available and/or future developed systems and/or devices capable of increasing the pressure of the received gaseous $CO_2$ to provide a compressed gaseous $CO_2$ at a twelfth temperature ($T_{12}$) 252 and a twelfth pressure ($P_{12}$) 254. In embodiments, the second compressor 240 may include one or more reciprocating compressors, one or more rotary compressors, one or more scroll compressors, or combinations thereof. In embodiments, the second compressor 240 may include one or more single- or multi-stage supersonic compressors that increase the density of the $CO_2$ using a supersonic shockwave. Selection of the second compressor 240 may be based on one or more factors, such as process operating conditions (e.g., the eleventh temperature 242 and the eleventh pressure 244); desired output conditions (e.g., the twelfth temperature 252 and/or the twelfth pressure 254); gaseous $CO_2$ flowrate; or any combination thereof. In embodiments, the second compressor 240 receives a power input 246. In embodiments, the power input 246 may be provided, in whole or in part, by the first power output 226 of the turbine 220.

The second compressor 240 receives the cooled gaseous $CO_2$ at the eleventh temperature 242 and the eleventh pressure 244 and compresses the gaseous $CO_2$ to provide the gaseous $CO_2$ at the twelfth temperature 252 and the twelfth pressure 254. In embodiments, the second compressor 240 discharges the compressed gaseous $CO_2$ at a twelfth temperature 252 of: about 400° R to about 1,200° R; about 500° R to about 1,100° R; or about 600° R to about 1,000° R. In embodiments, the second compressor 240 discharges the compressed gaseous $CO_2$ at a twelfth pressure 254 of: about 2,000 psia to about 4,500 psia; about 2,500 psia to about 4,500 psia; or about 3,000 psia to about 4,500 psia. In embodiments, the liquefied $CO_2$ exiting the second compressor 240 at the twelfth temperature 252 and the twelfth pressure 254 may be apportioned into a first portion 256 directed to the combustor 210 and a second portion 258 directed to the heat exchanger 150 via the expansion valve 250. The second portion of liquid $CO_2$ 258 at the twelfth temperature 252 and the twelfth pressure 254 flashes through the expansion valve 250 to provide the multiphase $CO_2$ at the first temperature 113 and the first pressure 114 to the heat exchanger 150.

The natural gas compression subsystem 260 receives the first portion of the extracted natural gas 186 at the fifth temperature 182 and the fifth pressure 184. The natural gas compression subsystem 260 may include any number and/or combination of currently available and/or future developed systems and/or devices capable of increasing the pressure of the first portion of the extracted natural gas 186 from the fifth temperature 182 and the fifth pressure 184 to the second temperature 132 and the second pressure 134. In embodiments, the natural gas compression subsystem 260 may include one or more reciprocating compressors, one or more rotary compressors, one or more scroll compressors, or combinations thereof.

Selection of the natural gas compression subsystem 260 may be based on one or more factors, such as: one or more process operating conditions (e.g., the fifth temperature 182 and the fifth pressure 184); one or more desired output conditions (e.g., the second temperature 132 and/or the second pressure 134); natural gas flowrate; or combinations thereof.

The natural gas compression subsystem 260 may receive a power input 266. In some implementations, at least a portion of the power input 266 may be provided by the first power output 226 of the turbine 220. In some implementations, at least a portion of the power input 266 may be provided via a commercial, public, or private electrical generation and distribution network. In some implementations, the LNG production/NGL separation system 130 may include one or more gas expansion devices that provide a second power output. In such implementations, at least a portion of the power input 266 may be provided by the second power output of one or more gas expansion devices disposed in the LNG production/NGL separation system 130.

The natural gas liquid subsystem 270 receives the refrigerated natural gas at the third temperature 142 and the third pressure 144 from the heat exchanger 150 and condenses at least a portion of the refrigerated natural gas to provide the liquefied natural gas (LNG) product 160 at the sixth temperature 162 and at the sixth pressure 164. In embodiments, the natural gas liquid subsystem 270 condenses at least a portion of the refrigerated natural gas to separate one or more natural gas liquids (NGLs) from the extracted natural gas 180 to provide the natural gas liquid (NGL) product 170.

In embodiments, the natural gas liquid subsystem 270 may include any number and/or combination of currently available and/or future developed devices and/or systems capable of removing thermal energy from and reducing the temperature of the extracted natural gas received from the heat exchanger 150. The natural gas liquid subsystem 270 In embodiments, the natural gas liquid subsystem 270 may include a number of liquid and/or air cooled thermal transfer devices. In embodiments, the natural gas liquid subsystem 270 may include one or more expansion devices that reduce the temperature of the natural gas via Joule-Thompson cooling. In some embodiments, the natural gas liquid subsystem 270 may include one or more expansion devices that reduce the temperature of the natural gas using one or more turboexpanders. In embodiments, the natural gas liquid subsystem 270 may include one or more cryogenic devices and/or systems capable of reducing the temperature of the refrigerated natural gas using a series of temperature step changes. Such stepwise temperature changes permit the condensation and removal of $C_2$+ natural gas liquids (NGLs) from the first portion of the extracted natural gas 186. In embodiments, the natural gas liquid subsystem 270 may include one or more cryogenic separation and/or fractionation devices and/or systems capable of separating or fractionating $C_{2+}$ hydrocarbons.

The natural gas liquid subsystem 270 may receive a power input 276. In some implementations, at least a portion of the power input 276 may be provided by the first power output 226 of the turbine 220. In some implementations, at least a portion of the power input 276 may be provided via a commercial, public, or private electrical generation and distribution network. In some implementations, the LNG production/NGL separation system 130 may include one or more gas expansion devices that provide a second power output. In such implementations, at least a portion of the power input 276 may be provided by the second power output of one or more gas expansion devices disposed in the LNG production/NGL separation system 130.

Figure 3:
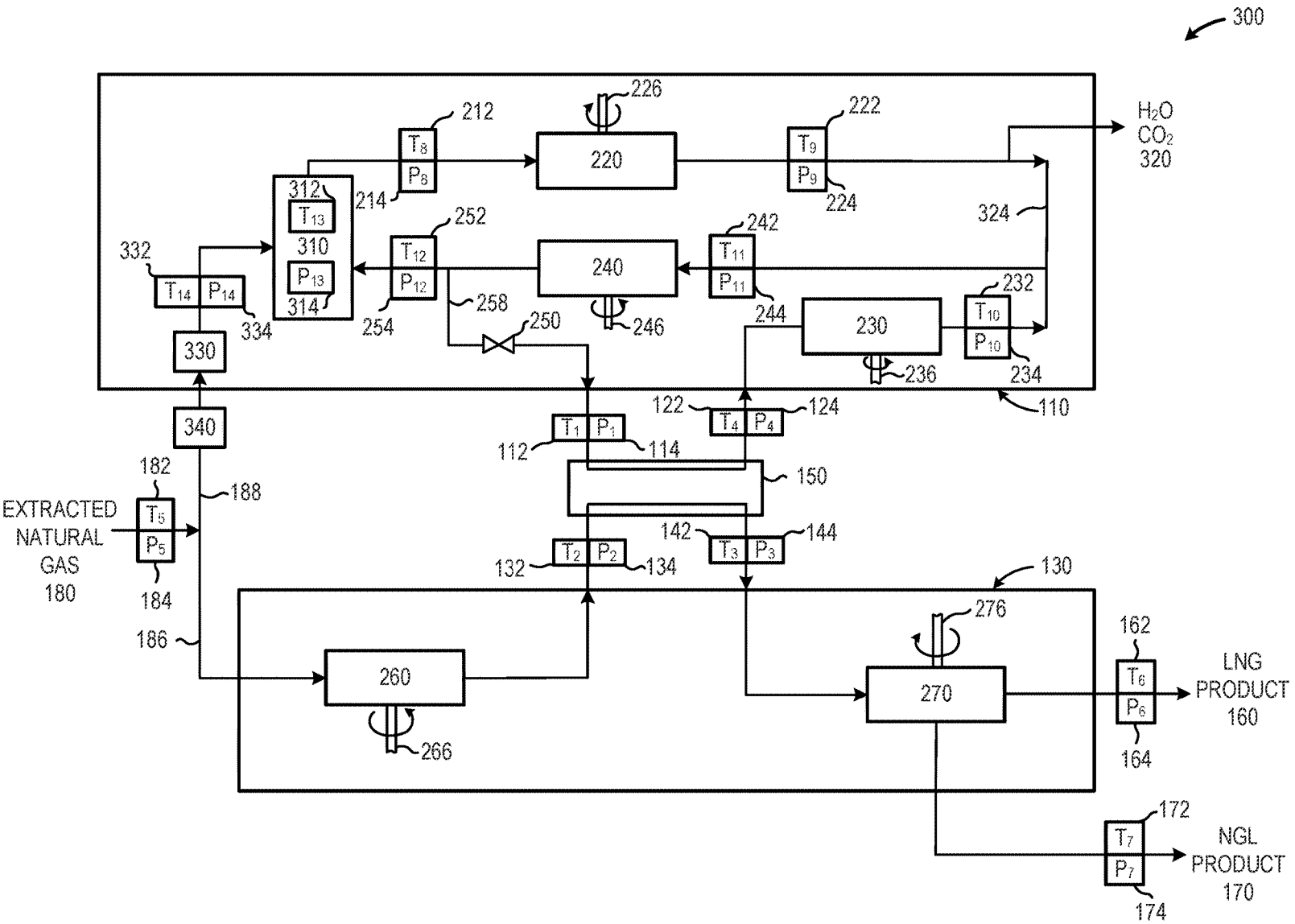
FIG. 3 is a block diagram of an illustrative integrated system incorporating a supercritical fluid power system that includes: a direct-fired combustor, a thermal transfer medium turbine, a first thermal transfer medium compressor, a second thermal transfer medium compressor, and an expansion valve, in accordance with at least one embodiment described herein.

FIG. 3 is a block diagram of an illustrative integrated system 300 incorporating a supercritical fluid power system 110 that includes: a direct-fired combustor 310, a turbine 220, a first compressor 230, a second compressor 240, and an expansion valve 250, in accordance with at least one embodiment described herein. The illustrative integrated system 300 also includes a LNG production/NGL separation system 130 that includes a natural gas compression subsystem 260 and a natural gas liquid subsystem 270. The direct-fired combustor 310 generates carbon dioxide and water vapor as byproducts of the combustion process. Excess carbon dioxide and water is removed from the system 300 via a blowdown 320.

The direct-fired combustor 310 receives and combusts all or a portion of the second portion 188 of the extracted natural gas 180. The direct-fired combustor 310 may include any number and/or combination of systems and/or devices capable of receiving the second portion 188 of the extracted natural gas 180 and combusting the extracted natural gas in the presence of stoichiometric and/or excess oxygen (in the form of pure oxygen or air) to produce a high temperature/high pressure effluent that includes $CO_2$ and water.

The direct-fired combustor 310 operates at an elevated thirteenth temperature ($T_{13}$) 312 and an elevated thirteenth pressure ($P_{13}$) 314. In embodiments, the direct-fired combustor 310 operates at a thirteenth temperature 312 that is greater than the critical temperature of $CO_2$ (i.e., greater than about 548° R). In embodiments, the direct-fired combustor 310 operates at a thirteenth pressure 314 that is greater than the critical pressure of $CO_2$ (i.e., greater than about 1,072 psia). In embodiments, the direct-fired combustor 310 may operate at a thirteenth temperature 312 of: about 550° R to about 3,500° R; about 750° R to about 3,000° R; or about 1,400° R to about 3,000° R. In embodiments, the direct-fired combustor 310 may operate at a thirteenth pressure 314 of: about 1,000 psia to about 6,000 psia; about 1,250 psia to about 5,500 psia; or about 1,500 psia to about 5,000 psia.

In embodiments, a preheater 330 may increase the temperature of the second portion 188 of the extracted natural gas 180 prior to introducing the second portion 188 of the extracted natural gas 180 to the direct-fired combustor 310. In embodiments, a boost compressor 340 may be used to increase the pressure of the second portion 188 of the extracted natural gas 180 prior to introducing the second portion 188 of the extracted natural gas 180 to the direct-fired combustor 310. In embodiments, the preheater 330 may include a heat exchange device and/or system using process waste heat from the supercritical fluid power generation system 110 and/or the LNG production/NGL separation system 130. In embodiments, the preheater 330 may provide the second portion 188 of the extracted natural gas 180 to the direct-fired combustor 310 at a fourteenth temperature ($T_{14}$) 332 and a fourteenth pressure ($P_{14}$) 334. In embodiments, the preheater 330 may provide the second portion 188 of the extracted natural gas 180 to the direct-fired heater at a fourteenth temperature 332 of: about 530° R to about 1200° R; about 530° R to about 1000° R; or about 500° R to about 750° R. In embodiments, the preheater 330 may provide the second portion 188 of the extracted natural gas to the direct-fired heater at a fourteenth pressure 334 of: about 1,100 psia to about 4,500 psia; about 1,100 psia to about 4,000 psia; or about 1,100 psia to about 3,500 psia.

Excess $CO_2$ and water produced by the combustion process in the direct-fired combustor 310 may be removed from the supercritical fluid power generation system 110 via the blowdown 320. In embodiments, the blowdown 320 may be located downstream of the turbine 220. In such embodiments, the discharge from the turbine 220 may be apportioned into a first portion that Excess $CO_2$ and water removed downstream of the turbine 220 may be at the ninth temperature 222 and the ninth pressure 224.

Figure 4:
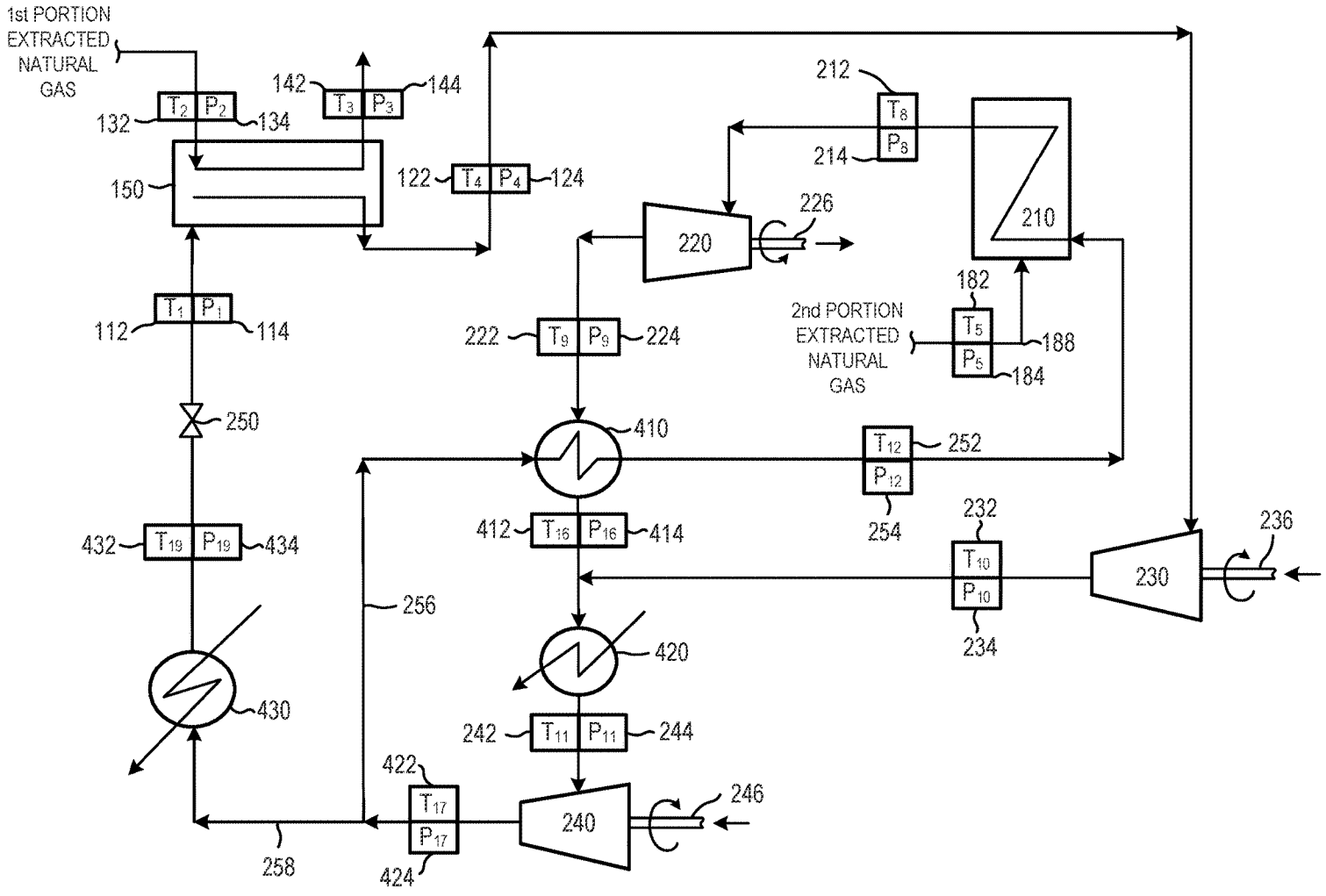
FIG. 4 is a process flow diagram of an illustrative supercritical fluid power generation system that includes a recuperator disposed between the thermal transfer medium turbine and the second thermal transfer medium compressor, a first thermal transfer medium cooler disposed between the recuperator and the second thermal transfer medium compressor, and a second thermal transfer medium cooler disposed between the second thermal transfer medium compressor and the expansion valve, in accordance with at least one embodiment described herein.

FIG. 4 is a process flow diagram of an illustrative supercritical fluid power generation system 400 that includes a recuperator 410 disposed between the turbine 220 and the second compressor 240, a first cooler 420 disposed between the recuperator 410 and the second compressor 240, and a second cooler 430 disposed between the second compressor 240 and the expansion valve 250, in accordance with at least one embodiment described herein. The recuperator 410 improves process thermal efficiency by using residual heat in the gaseous $CO_2$ discharged by the turbine 220 to preheat the supercritical $CO_2$ returned to the combustor 210.

The recuperator 410 may include any number and/or combination of currently available and/or future developed thermal energy transfer devices and/or systems capable of transferring thermal energy (i.e., heat) from the gaseous $CO_2$ discharged by the turbine at the ninth temperature 222 to the supercritical $CO_2$ discharged by the second compressor 240 to provide the heated supercritical $CO_2$ to the combustor 210 at the twelfth temperature 252 and the twelfth pressure 254. The recuperator 410 may include one or more: shell and tube heat exchangers; plate and frame heat exchangers; microchannel heat exchangers; or combinations thereof.

In embodiments, the recuperator 410 receives the gaseous $CO_2$ discharged by the turbine at the ninth temperature 222 and the ninth pressure and discharges the gaseous $CO_2$ at a sixteenth temperature ($T_{16}$) 412 and a sixteenth pressure ($P_{16}$) 414. In embodiments, the recuperator receives the discharge from the second compressor 240 at a seventeenth temperature ($T_{17}$) 422 and a seventeenth pressure ($P_{17}$) 424 and discharges the supercritical $CO_2$ at the twelfth temperature 252 and the twelfth pressure 254.

The recuperator 410 receives the gaseous $CO_2$ from the turbine 220 at the ninth temperature 222 and the ninth pressure 224 and discharges the gaseous $CO_2$ at the sixteenth temperature 412 and the sixteenth pressure 414. In embodiments, the gaseous $CO_2$ discharge from the recuperator 410 may have a sixteenth temperature 412 of: about 400° R to about 1,200° R; about 500° R to about 1,100° R; or about 600° R to about 1,000° R. In embodiments, the gaseous $CO_2$ discharge from the recuperator 410 may have a sixteenth pressure 414 of: about 200 psia to about 1,200 psia; about 300 psia to about 1,000 psia; or about 400 psia to about 1,000 psia.

The recuperator 410 receives the supercritical $CO_2$ from the second compressor 240 at the seventeenth temperature 422 and the seventeenth pressure 424 and discharges the supercritical $CO_2$ at the twelfth temperature 252 and the twelfth pressure 254. In embodiments, the recuperator 410 receives the supercritical $CO_2$ from the second compressor 240 at a seventeenth temperature 422 of: about 400° R to about 1,200° R; about 500° R to about 1,100° R; or about 600° R to about 1,000° R. In embodiments, the recuperator 410 receives the supercritical $CO_2$ from the second compressor 240 at a seventeenth pressure 424 of: about 2,000 psia to about 4,500 psia; about 2,500 psia to about 4,500 psia; or about 3,000 psia to about 4,500 psia.

The heat transfer area of the recuperator 410 may be selected based on a number of factors that include, but are not limited to: inlet gaseous $CO_2$ temperature (i.e., the ninth temperature 222); inlet supercritical $CO_2$ temperature (i.e., the seventeenth temperature 422); desired gaseous $CO_2$ outlet temperature (i.e., the sixteenth temperature 412); desired supercritical $CO_2$ outlet temperature (i.e., the twelfth temperature 252); gaseous $CO_2$ flowrate; supercritical $CO_2$ flowrate; or combinations thereof.

The compressed gaseous $CO_2$ discharged by the first compressor at the tenth temperature 232 and the tenth pressure 234 combines with the gaseous $CO_2$ exiting the recuperator 410 at the sixteenth temperature 412 and the sixteenth pressure 414. A first cooler 420 receives the combined gaseous $CO_2$ from the recuperator 410 and the first compressor 230. The first cooler 420 discharges the gaseous $CO_2$ at the eleventh temperature 242 and the eleventh pressure 244.

The first cooler 420 may include any number and/or combination of currently available and/or future developed devices and/or systems capable of reducing the temperature of the gaseous $CO_2$ to provide the second compressor 240 with gaseous $CO_2$ at the eleventh temperature 242 and the eleventh pressure 244. In embodiments, the first cooler 420 may include one or more air cooled devices that reduce the temperature of the gaseous $CO_2$ via thermal transfer to either a forced or a natural draft airflow. In embodiments, the first cooler 420 may include one or more liquid cooled devices that reduce the temperature of the gaseous $CO_2$ via thermal transfer to a liquid coolant such as water, glycol solutions, or similar. The first cooler 420 may be selected based on a number of factors that include, but are not limited to: the temperature of the combined gaseous $CO_2$ provided by the recuperator 410 and the first compressor 230; the desired temperature of the gaseous $CO_2$ provided to the second compressor 240 (i.e., the eleventh temperature 242); the gaseous $CO_2$ flowrate; or combinations thereof.

The second compressor 240 discharges supercritical $CO_2$ at the seventeenth temperature 422 and the seventeenth pressure 424. The recuperator 410 receives a first portion 256 of the supercritical $CO_2$. The expansion valve 250 receives a second portion 258 of the supercritical $CO_2$ via a second cooler 430. The second cooler 430 receives the supercritical $CO_2$ at the seventeenth temperature 422 and the seventeenth pressure 424 from the second compressor 240 and discharges supercritical $CO_2$ at a nineteenth temperature ($T_{19}$) 432 and a nineteenth pressure ($P_{19}$) 434 to the expansion valve 250.

The second cooler 430 may include any number and/or combination of currently available and/or future developed devices and/or systems capable of reducing the temperature of the supercritical $CO_2$ from the second compressor 240 to provide the expansion valve 250 with supercritical $CO_2$ at the nineteenth temperature 432 and the nineteenth pressure 434. In embodiments, the second cooler 430 may include one or more air cooled devices that reduce the temperature of the supercritical $CO_2$ via thermal transfer to either a forced or a natural draft airflow. In embodiments, the second cooler 430 may include one or more liquid cooled devices that reduce the temperature of the supercritical $CO_2$ via thermal transfer to a liquid coolant such as water, glycol solutions, or similar. The second cooler 430 may be sized and/or selected based on a number of factors that include, but are not limited to: the temperature of the supercritical $CO_2$ provided by the second compressor 240; the desired temperature of the supercritical $CO_2$ provided to the expansion valve 250 (i.e., the nineteenth temperature 432); the supercritical $CO_2$ flowrate; or combinations thereof.

The second cooler 430 receives the supercritical $CO_2$ from the second compressor 240 at the seventeenth temperature 422 and the seventeenth pressure 424 and discharges the supercritical $CO_2$ at the nineteenth temperature 432 and the nineteenth pressure 434. In embodiments, the expansion valve 250 receives the supercritical $CO_2$ from the second cooler 430 at a nineteenth temperature 432 of: about 300° R to about 900° R; about 400° R to about 750° R; or about 500° R to about 600° R. In embodiments, the expansion valve 250 receives the supercritical $CO_2$ from the second cooler 430 at a nineteenth pressure 434 of: about 500 psia to about 6,000 psia; about 750 psia to about 5,000 psia; or about 1,000 psia to about 4,500 psia.

Figure 5:
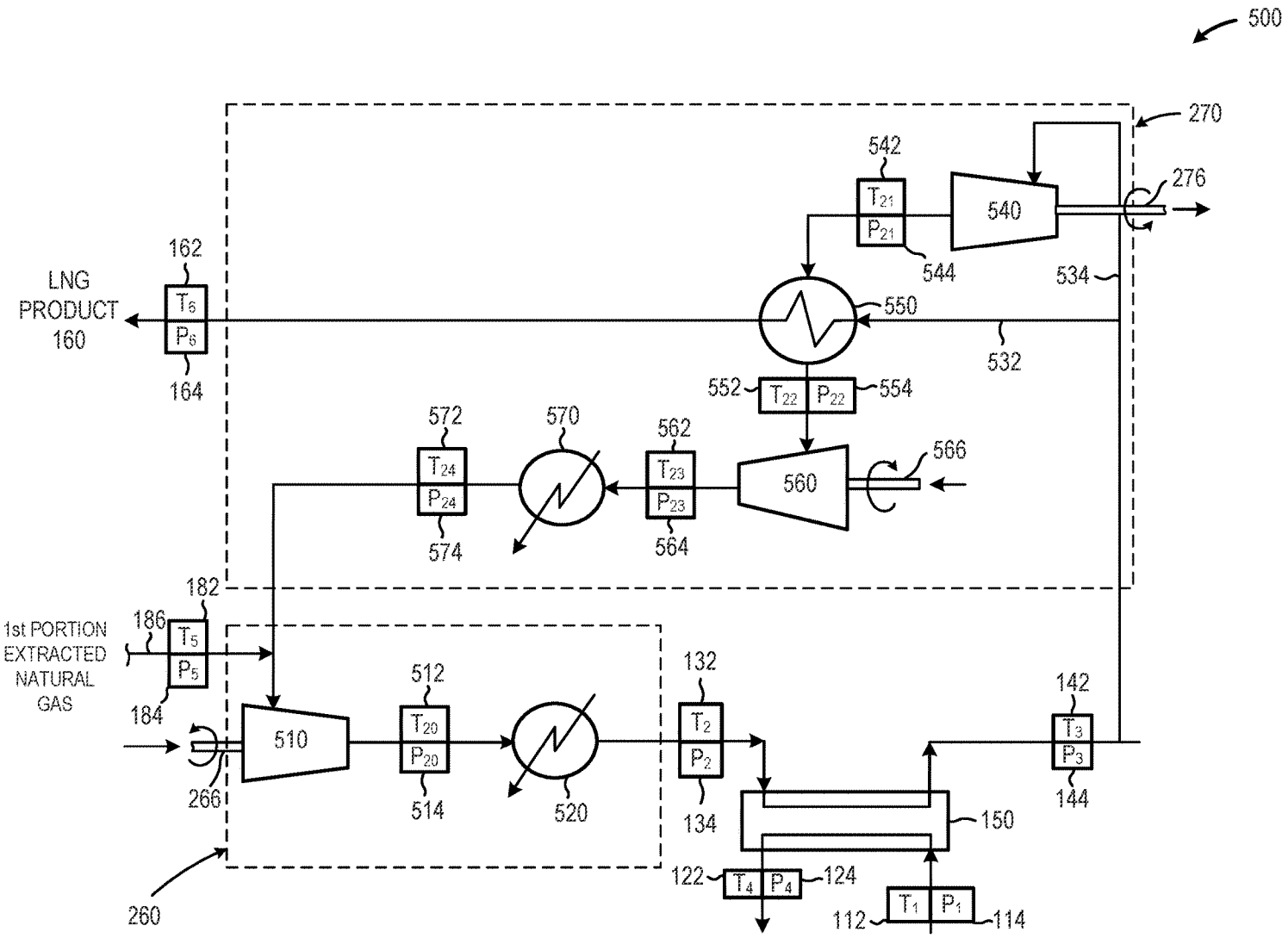
FIG. 5 is a process flow diagram of an illustrative LNG production/NGL separation system that incorporates a natural gas compression subsystem that includes a first natural gas (NG) compressor receiving the power input and a first NG cooler and a LNG/NGL separation subsystem that includes a NG turbine producing the power output, a NG heat exchanger, a second NG compressor, and a second NG cooler, in accordance with at least one embodiment described herein.

FIG. 5 is a process flow diagram of an illustrative LNG production/NGL separation system 500 that incorporates a natural gas compression subsystem 260 that includes a first compressor 510 receiving the power input 266 and a first cooler 520 and a LNG/NGL separation subsystem 270 that includes a gas expansion system 540 producing the power output 276, a heat exchanger 550, a second compressor 560, and a second cooler 570, in accordance with at least one embodiment described herein. In embodiments, the refrigerated natural gas exiting the heat exchanger 150 at the third temperature 142 and the third pressure 144 may be apportioned into a first portion 532 that provides the LNG product 160 and a second portion 534 that is recycled to the first compressor 510 in the natural gas compression subsystem 260.

In embodiments, the natural gas compression subsystem 260 includes the first natural gas ("NG") compressor 510 and the first NG cooler 520. In embodiments, the first NG compressor 510 receives the first portion 186 of the extracted natural gas 180. In embodiments, the first NG compressor 510 may also receive the first portion 534 of natural gas recycled from the heat exchanger 550. The first NG compressor 510 discharges the compressed natural gas at a twentieth temperature ($T_{20}$) 512 and a twentieth pressure ($P_{20}$) 514 to the first cooler 520. The first NG cooler 520 discharges the compressed natural gas at the second temperature 132 and the second pressure 134.

The first NG compressor 510 receives the incoming first portion of extracted natural gas 186. The first NG compressor 510 may include any number and/or combination of currently available and/or future developed systems and/or devices capable of increasing the pressure of the first portion of extracted natural gas 186 to provide a compressed first portion of extracted natural gas 186 at a twentieth temperature ($T_{20}$) 512 and a twentieth pressure ($P_{20}$) 514. In embodiments, the first NG compressor 510 may include one or more reciprocating compressors, one or more rotary compressors, one or more scroll compressors, or combinations thereof. Selection of the first NG compressor 510 may be based on one or more factors, such as process operating conditions (e.g., the fifth temperature 182 and/or the fifth pressure 184); desired output conditions (e.g., the twentieth temperature 512 and/or the twentieth pressure 514); natural gas flowrate; or any combination thereof. In embodiments, the first NG compressor 510 receives a power input 266. In embodiments, the power input 266 may be provided, in whole or in part, by the first power output 226 of the turbine 220 in the supercritical fluid power generation system 110 and/or the natural gas turbine 540 in the natural gas liquid subsystem 270.

The first NG compressor 510 receives the first portion of the extracted natural gas 186 at the fifth temperature 182 and the fifth pressure 184 and compresses the first portion of the extracted natural gas 186 to provide a compressed natural gas at the twentieth temperature 512 and the twentieth pressure 514. In embodiments, the first NG compressor 510 discharges the compressed natural gas at a twentieth temperature 512 of: about 460° R to about 1,000° R; about 500°

R to about 800° R; or about 500° R to about 650° R. In embodiments, the first NG compressor 510 discharges the compressed natural gas at a twentieth pressure 514 of: about 100 psia to about 1,500 psia; about 150 psia to about 500 psia; or about 200 psia to about 400 psia.

The first NG cooler 520 may include any number and/or combination of currently available and/or future developed devices and/or systems capable of reducing the temperature of the compressed natural gas to provide the heat exchanger 150 with compressed natural gas at the second temperature 132 and the second pressure 134. In embodiments, the first NG cooler 520 may include one or more air cooled devices that reduce the temperature of the compressed natural gas via thermal transfer to either a forced or a natural draft airflow. In embodiments, the first NG cooler 520 may include one or more evaporative cooling devices that reduce the temperature of the compressed natural gas via thermal transfer to either a forced or a natural draft humidified airflow. In embodiments, the first NG cooler 520 may include one or more liquid cooled devices that reduce the temperature of the gaseous $CO_2$ via thermal transfer to a liquid coolant such as water, glycol solutions, or similar. The first NG cooler 520 may be selected based on a number of process-related factors that include, but are not limited to: the temperature of the compressed natural gas provided by the first NG compressor 510 (i.e., the twentieth temperature 512); the desired compressed natural gas discharge temperature (i.e., the second temperature 122); the compressed natural gas flowrate; or combinations thereof.

The compressed natural gas provided to the heat exchanger 150 exits the heat exchanger 150 as a refrigerated natural gas at the third temperature 142 and the third pressure 144. The refrigerated natural gas exiting the heat exchanger 150 may be apportioned into a first portion 532 that is withdrawn to provide the liquefied natural gas product 160 and a second portion 534 that is expanded through a NG turbine 540 to provide expanded natural gas used for cooling and liquefying the first portion of refrigerated natural gas 532 via one or more NG condensers 550.

The first portion of the refrigerated natural gas 532 may include: about 80 vol % or less; about 70 vol % or less; about 60 vol % or less; or about 50 vol % or less of the total refrigerated natural gas discharged from the heat exchanger 150 at the third temperature 142 and the third pressure 144. The second portion of the refrigerated natural gas 534 may include: about 20 vol % or more; about 30 vol % or more; about 40 vol % or more; or about 50 vol % or more of the total refrigerated natural gas discharged from the heat exchanger 150 at the third temperature 142 and the third pressure 144.

In embodiments, the NG turbine 540 receives the first portion of the refrigerated natural gas 534 at the third temperature 142 from the heat exchanger 150. The first portion of the refrigerated natural gas 534 expands through the NG turbine 540 generating power output 276.

The expansion of the natural gas through the NG turbine 540 cools the natural gas, which exits the NG turbine at a twenty-first temperature ($T_{21}$) 542 and a twenty-first pressure ($P_{21}$) 544. The expanded natural gas may exit the NG turbine 540 as a gas, a liquid, or a multiphase condition that includes both liquid and gases. In embodiments, the NG turbine 540 may discharge the expanded natural gas at a twenty-first temperature 542 of: about 100° R to about 600° R; about 150° R to about 500° R; or about 200° R to about 450° R. In embodiments, the NG turbine 540 may discharge the expanded natural gas at a twenty-first pressure 544 of: about 15 psia to about 700 psia; about 15 psia to about 500 psia; about 15 psia to about 300 psia; or about 15 psia to about 200 psia; or about 15 psia to about 100 psia.

The NG turbine 540 may include any number and/or combination of currently available and/or future developed systems and/or devices capable of receiving refrigerated natural gas from the heat exchanger 150 at the third temperature 142 and the third pressure 144, expanding the refrigerated natural gas to provide the expanded natural gas at the twenty-first temperature 542 and the twenty-first pressure 544, and producing the power output 276. The NG turbine 540 may include a single- or multi-stage turbine and/or turboexpander. In embodiments, the power output 276 may include a rotating shaft output. In embodiments, the power output 276 may include a rotating shaft output that may be used to provide all or a portion of a power input to an electrical production device or system, such as an electrical generator.

The NG turbine 540 discharges the expanded natural gas at the twenty-first temperature 542 and the twenty-first pressure 544 to the NG condenser 550. Within the natural gas condenser 550, the expanded natural gas received from the NG turbine 540 cools and condenses the first portion of the refrigerated natural gas 532 received from the heat exchanger 150. The expanded natural gas exits the NG condenser 550 at a twenty-second temperature ($T_{22}$) 552 and a twenty-second pressure ($P_{22}$) 554. The natural gas condenser receives the first portion of the refrigerated natural gas 532 from the heat exchanger 150 at the third temperature 142 and the third pressure 144 and discharges liquefied natural gas product 160 at the sixth temperature 162 and the sixth pressure 164.

The NG condenser 550 may include any number and/or combination of currently available and/or future developed devices and/or systems capable of receiving the expanded natural gas at the twenty-first temperature 542 and the twenty-first pressure 544 and condensing the first portion of the refrigerated natural gas at the third temperature 142 and the third pressure 144 to provide the liquefied natural gas product 160 at the sixth temperature 162 and the sixth pressure 164. The NG condenser 550 may include one or more shell and tube heat exchangers; one or more plate and frame heat exchangers; one or more microchannel heat exchangers; one or more knockback condensers; or combinations thereof. The heat transfer area of NG condenser 550 may be selected based on a number of factors that include, but are not limited to: inlet expanded natural gas temperature (i.e., the twenty-first temperature 542); inlet refrigerated natural gas temperature (i.e., the third temperature 142); desired expanded natural gas outlet temperature (i.e., the twenty-second temperature 552); desired liquefied natural gas outlet temperature (i.e., the sixth temperature 162); expanded natural gas flowrate; liquefied natural gas flowrate; or combinations thereof.

The NG condenser 550 discharges the expanded natural gas at the twenty-second temperature 552 and the twenty-second pressure 554. In embodiments, the NG condenser 550 may discharge the expanded natural gas from the NG turbine 550 at a twenty-second temperature 552 of: about 200° R to about 600° R; about 200° R to about 500° R; or about 200° R to about 450° R. In embodiments, the NG condenser 550 may discharge the expanded natural gas from the NG turbine 550 at a twenty-second pressure 554 of: about 15 psia to about 700 psia; about 15 psia to about 500 psia; about 15 psia to about 300 psia; or about 15 psia to about 200 psia; or about 15 psia to about 100 psia.

The second NG compressor 560 receives all or a portion of the expanded natural gas NG discharged from the NG condenser 550. Using a second power input 566, the second NG compressor 560 increases the pressure of the expanded natural gas to provide a compressed natural gas at a twenty-third temperature ($T_{23}$) 562 and a twenty-third pressure ($P_{23}$) 564. The second NG compressor 560 may include any number and/or combination of currently available and/or future developed systems and/or devices capable of increasing the pressure of the expanded natural gas received from the NG condenser 550. In embodiments, the second NG compressor 560 may include one or more reciprocating compressors, one or more rotary compressors, one or more scroll compressors, or combinations thereof. Selection of the second NG compressor 560 may be based on one or more factors, such as process operating conditions (e.g., the twenty-second temperature 552 and the twenty-second pressure 554); desired compressed natural gas output conditions (e.g., the twenty-third temperature 562 and/or the twenty-third pressure 564); the natural gas flowrate; or any combination thereof. In embodiments, the second NG compressor 560 receives a power input 566. In embodiments, the power input 566 may be provided, in whole or in part, by the first power output 226 of the turbine 220 in the supercritical fluid power generation system 110 and/or the power output 276 of the NG turbine 540 in the natural gas liquid subsystem 270.

The second NG compressor 560 receives the expanded natural gas at the twenty-second temperature 552 and the twenty-second pressure 554 and compresses the natural gas 186 to provide a compressed natural gas at the twenty-third temperature 562 and the twenty-third pressure 564. In embodiments, the second NG compressor 560 discharges the compressed natural gas at a twenty-third temperature 562 of: about 460° R to about 1,000° R; about 500° R to about 800° R; or about 500° R to about 650° R. In embodiments, the second NG compressor 560 discharges the compressed natural gas at a twenty-third pressure 564 of: about 30 psia to about 1,500 psia; about 30 psia to about 1,250 psia; or about 30 psia to about 1,000 psia.

The second NG cooler 570 may include any number and/or combination of currently available and/or future developed devices and/or systems capable of reducing the temperature of the compressed natural gas received from the second NG compressor 560. The second NG cooler 570 discharges the cooled natural gas at a twenty-fourth temperature ($T_{24}$) 572 and a twenty-fourth pressure ($P_{24}$) 574. In embodiments, at least a portion of the cooled natural gas discharged by the second NG cooler 570 may be combined with the first portion of the extracted natural gas 186 to provide the feed to the first NG compressor 510.

In embodiments, the second NG cooler 570 may include one or more air cooled devices that reduce the temperature of the compressed natural gas via thermal transfer to either a forced or a natural draft airflow. In embodiments, the second NG cooler 570 may include one or more evaporative cooling devices that reduce the temperature of the compressed natural gas via thermal transfer to either a forced or a natural draft humidified airflow. In embodiments, the second NG cooler 570 may include one or more liquid cooled devices that reduce the temperature of the gaseous $CO_2$ via thermal transfer to a liquid coolant such as water, glycol solutions, or similar. The second NG cooler 570 may be selected based on a number of process-related factors that include, but are not limited to: the temperature of the compressed natural gas provided by the second NG compressor 560 (i.e., the twenty-third temperature 562); the desired compressed natural gas discharge temperature (i.e., the twenty-fourth temperature 572); the compressed natural gas flowrate; or combinations thereof.

The second NG cooler 570 receives the compressed natural gas at the twenty-third temperature 562 and the twenty-third pressure 564 and cools the compressed natural gas to the twenty-fourth temperature 572 and the twenty-fourth pressure 574. In embodiments, the second NG cooler 570 discharges the cooled natural gas at a twenty-fourth temperature 572 of: about 400° R to about 600° R; about 400° R to about 550° R; or about 400° R to about 500° R. In embodiments, the second NG cooler 570 discharges the cooled natural gas at a twenty-fourth pressure 574 of: about 30 psia to about 1000 psia; about 30 psia to about 250 psia; or about 30 psia to about 200 psia.

Figure 6:
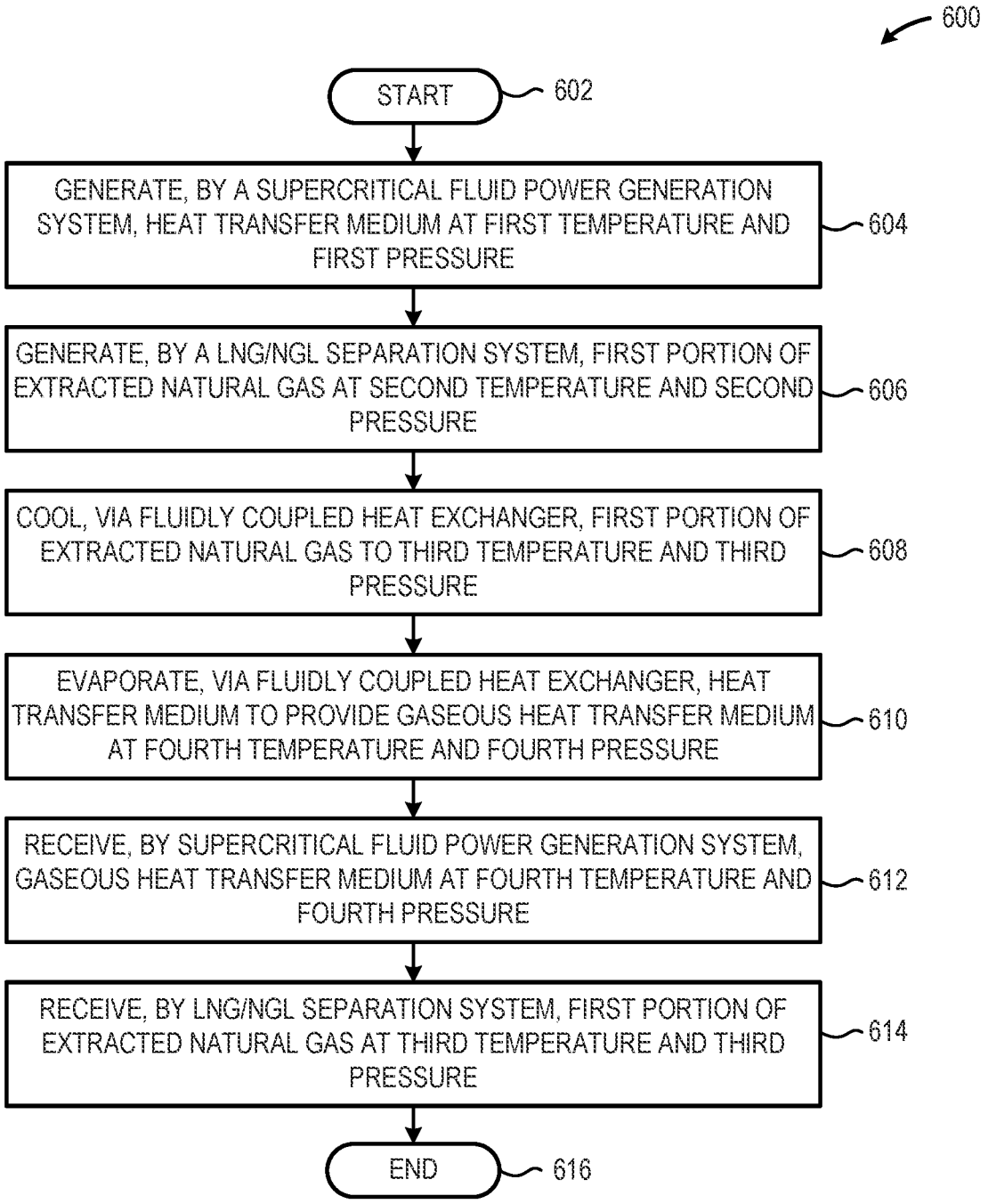
FIG. 6 is a flow diagram of an illustrative natural gas liquefaction method using a heat exchanger coupled to a supercritical fluid power generation system to provide heat transfer medium to provide at least a portion of the cooling for use in a LNG production/NGL separation system, in accordance with at least one embodiment described herein.

FIG. 6 is a flow diagram 600 of an illustrative natural gas liquefaction method using a heat exchanger 150 coupled to a supercritical fluid power generation system 110 to provide heat transfer medium to provide at least a portion of the cooling for use in a LNG production/NGL separation system 130, in accordance with at least one embodiment described herein. In embodiments, the cooling provided by the thermal transfer medium may be used for the liquefaction of extracted natural gas and/or the separation of one or more natural gas liquids (NGLs) from the extracted natural gas. In embodiments, the supercritical fluid power generation system may include a combustor 210 or similar thermal energy input device (reactor, collector, waste heat boiler, etc.). In embodiments, the supercritical fluid power generation system 110 may include a direct- or indirect-fired Brayton power generation cycle using $CO_2$ as the thermal transfer medium. In such embodiments, a portion of the extracted natural gas may be used as a fuel source by the supercritical fluid power generation system. The method commences at 602.

At 604, the supercritical fluid power generation system 110 generates a relatively cool heat transfer medium, such as a multiphase carbon dioxide, at a first temperature 112 and a first pressure 114. In at least some embodiments, the relatively cool multiphase heat transfer medium may be produced by passing a relatively high pressure heat transfer medium through an expansion valve 250 or similar device capable of producing the relatively cool multiphase heat transfer medium via the Joule-Thomson effect.

At 606, the LNG production/NGL separation system 130 generates a relatively warm extracted natural gas at a second temperature 132 and a second pressure 134. In some implementations, the relatively warm natural gas may be generated by compressing a first portion of the extracted natural gas 186 using a first NG compressor 510.

At 608, a heat exchanger 150 thermally couples the relatively warm first portion of the extracted natural gas from the LNG production/NGL separation system 130 to the relatively cool heat transfer medium from the supercritical fluid power generation system 110. The heat from the relatively warm first portion of the extracted natural gas causes at least a portion of the heat transfer medium to evaporate, cooling the first portion of the extracted natural gas 186 to the third temperature 142 and the third pressure 144.

At 610, at least a portion of the heat transfer medium evaporates within the heat exchanger 150, cooling the first portion of the extracted natural gas 186. The relatively warm gaseous heat transfer medium exits the heat exchanger 150 from at the fourth temperature 122 and the fourth pressure 124.

At 612, the gaseous heat transfer medium at the fourth temperature 122 and the fourth pressure 124 returns to the supercritical fluid power generation system 110. Within the supercritical fluid power generation system 110 the gaseous heat transfer medium is compressed and heated to an eighth temperature 212 and an eighth pressure 214 that exceeds the critical temperature and pressure of the heat transfer medium. For example, where $CO_2$ is used as the heat transfer medium, the eighth temperature 212 will be in excess of 548° R and the eighth pressure will be in excess of 1072 psia. The supercritical heat transfer medium may be expanded through a turbine 220 to generate a power output 226 that may be used to provide all or a portion of the power input to compress the gaseous heat transfer medium.

At 614, the refrigerated first portion of the extracted natural gas 186 is further cooled to produce a liquefied natural gas (LNG) product 160. In embodiments, one or more natural gas liquid (NGL) products 170 may be cryogenically separated from the first portion of the extracted natural gas 186. The method 600 concludes at 616.

While FIG. 6 illustrates an LNG production process according to one or more embodiments, it is to be understood that not all of the operations depicted in FIG. 6 may be necessary for other embodiments. Indeed, it is fully contemplated herein that in other embodiments of the present disclosure, the operations depicted in FIG. 6, and/or other operations described herein, may be combined in a manner not specifically shown in any of the drawings, but still fully consistent with the present disclosure. Thus, claims directed to features and/or operations that are not exactly shown in one drawing are deemed within the scope and content of the present disclosure.

As used in this application and in the claims, a list of items joined by the term "and/or" can mean any combination of the listed items. For example, the phrase "A, B and/or C" can mean A; B; C; A and B; A and C; B and C; or A, B and C. As used in this application and in the claims, a list of items joined by the term "at least one of" can mean any combination of the listed terms. For example, the phrases "at least one of A, B or C" can mean A; B; C; A and B; A and C; B and C; or A, B and C.

The systems and methods described herein provide a supercritical fluid power generation system thermally coupled to a LNG production/NGL separation system via one or more heat exchangers or similar thermal transfer units that advantageously permit the direct exchange thermal energy between the thermal transfer medium (e.g., $CO_2$) used in the supercritical fluid power generation system and an extracted natural gas stream. The systems and methods described herein beneficially and advantageously eliminate the use of intermediate heat transfer medium by using the thermal transfer medium in the supercritical fluid power generation system as a refrigerant in the LNG production/NGL separation system. By reducing or even eliminating the use of water in both the supercritical fluid power generation system and LNG production/NGL separation system, the systems and methods described herein are suitable for use in remote and/or arid locations where utilities and water may not be readily available. The systems and methods described herein use extracted natural gas as the primary fuel source for the supercritical fluid power generation system and may therefore be considered self-sufficient, beneficially requiring no external fuel supply.

The supercritical fluid power generation system includes a system using a direct- or an indirect-fired Brayton cycle to produce a supercritical thermal transfer fluid that is expanded through a power generation turbine. The cooled thermal transfer fluid passes through one or more heat exchangers thermally coupled to the LNG production/NGL separation system. The cooled thermal transfer fluid evaporates within the one or more heat exchangers, providing primary refrigeration to the extracted natural gas passed through the one or more heat exchangers by the LNG production/NGL separation system. In embodiments, the LNG production/NGL separation system may beneficially provide a liquefied natural gas (LNG) product at conditions suitable for shipment via ship, truck, rail, or pipeline (e.g., LNG at approximately 200° R and 15 psia). In embodiments, the LNG production/NGL separation system may cryogenically separate one or more natural gas liquid (NGL) products from the extracted natural gas.

The terms and expressions which have been employed herein are used as terms of description and not of limitation, and there is no intention, in the use of such terms and expressions, of excluding any equivalents of the features shown and described (or portions thereof), and it is recognized that various modifications are possible within the scope of the claims. Accordingly, the claims are intended to cover all such equivalents.

What is claimed is:

1. A natural gas processing method, comprising:

with a supercritical fluid power generation system:

receiving a thermal energy input generating a multiphase heat transfer medium comprising carbon dioxide at a temperature T1 and a pressure P1; and generating a power output;

with a natural gas compression subsystem of a LNG production/LNG separation system that receives a first portion of extracted natural gas and separately receives at least a portion of the power output from the supercritical fluid power generation system, and providing the first portion of the extracted natural gas at a temperature T2 and pressure P2, wherein T2>T1;

with a heat exchanger of the LNG production/LNG separation system fluidly coupled to the supercritical fluid power generation system, the natural gas compression subsystem, and a natural gas liquid subsystem of the LNG production/LNG separation system:

receiving the multiphase heat transfer medium at T1, P1 from the supercritical power generation system;

cooling the first portion of the extracted natural gas at T2, P2 with the multiphase heat transfer medium at T1, P1 to produce extracted natural gas at a temperature T3 and a pressure P3, wherein T3<T2;

evaporating at least a portion of the multiphase heat transfer medium to provide a gaseous heat transfer medium at a temperature T4 and a pressure P4, wherein T4>T3; and conveying the gaseous heat transfer medium at T4, P4 to the supercritical fluid power generation system; and receiving, with the natural gas liquid subsystem, at least a portion of the power output from the supercritical fluid power generation system.

2. The natural gas processing method of claim 1, wherein the natural gas compression subsystem comprises a natural gas compressor, and the method further comprises, with the natural gas compressor:

receiving the first portion of the extracted natural gas at a temperature T5 and a pressure P5; and increasing the temperature and pressure of the first portion of the extracted natural gas at T5, P5 to provide the first portion of the extracted natural gas at T2, P2, wherein T2>T5 and P2>P5.

3. The natural gas processing method of claim 1, further comprising condensing, with the natural gas liquid subsystem, the first portion of extracted natural gas at T3, P3 to provide a liquefied natural gas (LNG) product at a temperature T6 and a pressure P6.

4. The natural gas processing method of claim 3, further comprising providing, with the natural gas liquid subsystem, a natural gas liquid (NGL) product at a temperature T7 and a pressure P7.

5. The natural gas processing method of claim 1, wherein the supercritical fluid power generation system further comprises a combustor and the method further comprises, with the combustor:

combusting a second portion of the extracted natural gas; and providing a supercritical heat transfer medium at T8 and a pressure P8.

6. The natural gas processing method of claim 5, wherein the supercritical fluid power generation system further comprises a turbine fluidly coupled to the combustor, a first compressor, a cooling system fluidly coupled to the first compressor and the turbine, a second compressor fluidly coupled to the cooling system, and an expansion valve, and the method further comprises:

with the turbine:

receiving the supercritical heat transfer medium at T8, P8; and expanding the supercritical transfer medium at T8, P8 to produce the power output and a gaseous heat transfer medium at a temperature T9 and a pressure P9;

with the first compressor:

receiving the gaseous heat transfer medium at T4, P4 from the heat exchanger; and compressing the gaseous heat transfer medium at T4, P4 to provide a gaseous heat transfer medium at a temperature T10 and a pressure P10;

with the cooling system, receiving at least a portion of the gaseous heat transfer medium at T9, P9 and at least a portion of the gaseous heat transfer medium at T10, P10 to produce a gaseous heat transfer medium at a temperature T11 and a pressure P11;

with the second compressor:

receiving the gaseous heat transfer medium at T11, P11; and compressing and cooling the gaseous heat transfer medium at T11, P11 to provide a liquid heat transfer medium at a temperature T12 and a pressure P12; and with the expansion valve:

receiving the liquid heat transfer medium at T12, P12; and expanding at least a portion of the liquid heat transfer medium at T12, P12 to provide the multiphase heat transfer medium at T1, P1.

7. The natural gas processing method of claim 1, wherein the supercritical fluid power generation system comprises a recuperated indirect-fired Brayton cycle recuperative power generation system.

8. The natural gas processing method of claim 1, wherein the supercritical fluid power generation system comprises a direct-fired Brayton cycle power generation system.

9. The natural gas processing method of claim 8, wherein the direct-fired Brayton cycle power generation system comprises a recuperated direct-fired Brayton cycle power generation system.

10. The natural gas processing method of claim 8, further comprising, with said direct-fired Brayton cycle power generation system, providing a blowdown comprising carbon dioxide and water.

11. The natural gas processing method of claim 1, wherein the heat exchanger comprises one or more microchannel heat exchangers.

* * * * *